US005393367A

United States Patent [19]

Yu Chen

[11] Patent Number: 5,393,367

[45] Date of Patent: Feb. 28, 1995

[54] TAPE DISPENSER WITH A PROTECTED CUTTING DEVICE

[76] Inventor: Hsiu-Man Yu Chen, No.40, Sec.1, Ta-Fu Rd., Tung-Pao Tsun, Tan-Tzu Hsiang, Taichung Hsien, Taiwan, Prov. of China

[21] Appl. No.: 220,966

[22] Filed: Mar. 31, 1994

[51] Int. Cl.[6] ..... B32B 31/00

[52] U.S. Cl. ..... 156/523; 156/527; 156/579; 225/20

[58] Field of Search ..... 156/523, 527, 530, 574, 156/577, 579; 225/19, 20, 77, 80

[56] References Cited

U.S. PATENT DOCUMENTS 4,762,586 8/1988 Wilkie ..... 156/579 X
5,022,576 6/1991 Jenq ..... 225/20
5,024,362 6/1991 Karlsson ..... 225/20
5,110,401 5/1992 Huang ..... 156/579 X
5,236,540 8/1993 Shi ..... 156/527 X

*Primary Examiner*—David A. Simmons
*Assistant Examiner*—James J. Engel
*Attorney, Agent, or Firm*—Bliss, McGlynn

[57] ABSTRACT

A tape dispenser includes a tape dispensing port for guiding a packing tape and a cutting device for cutting an adhered portion of the packing tape from a tape end portion which is pulled out from the tape dispensing port. The cutter device includes a blade holding seat with a front edge disposed adjacent to a tape extending route and a rear edge opposite to the front edge, and a blade mounted on the holding seat. The blade has a cutting edge projecting outwardly from the front edge of the holding seat. A blade protecting shield is disposed movably above the blade. The blade protecting shield has a first edge projecting automatically beyond the cutting edge of the blade to protect the cutting edge.

6 Claims, 6 Drawing Sheets

TAPE DISPENSER WITH A PROTECTED CUTTING DEVICE

BACKGROUND OF THE INVENTION

1. Field of the Invention

The invention relates to a tape dispenser, more particularly to a tape dispenser which has a cutting device that is provided with a blade protecting shield.

2. Description of the Related Art

A tape dispenser comprises generally a tape storage station and a tape dispensing port which is spaced from the tape storage station. Referring to FIGS. 1 and 2, a conventional portable tape dispenser is shown to comprise a mounting frame 10 which includes a pair of spaced side plates 111 and a base plate 112 extending between the side plates 111 thereof. The mounting frame 10 has a tape storage station formed at a first end portion thereof and in which a roll 101 of packing tape 15 is mounted detachably and rotatably, and a tape dispensing port at a second end portion thereof. A positioning roller 102 is mounted at the tape dispensing port for guiding the packing tape 15 out of the dispensing port and for pressing the packing tape 15 on the surface of an object. A cutting device 12 is mounted between the spaced sides plates 111 of the mounting frame 10 adjacent to the positioning roller 102. The cutting device 12 includes a blade holding seat 120 fixed securely to the spaced side plates 111, a cutter blade 122 provided on the blade holding seat 120 and an L-shaped smoothing plate 123 which has a base portion 124 mounted detachably on the blade holding seat 120 so as to sandwich the cutter blade 122 securely between the base portion 124 of the L-shaped smoothing plate 123 and the blade holding seat 120. An L-shaped static adhesion plate 121 extends from the blade holding seat 120. A blade protecting shield 14 is hinged to a shaft 141 which is secured to the L-shaped smoothing plate 123 such that the blade protecting shield 14 dangles downward due to its weight so as to cover a cutting edge of the cutter blade 122 during normal conditions. The positioning roller 102 serves to press the adhered portion of the packing tape 15 against the desired surface.

In use, a distal end portion of the packing tape 15 is pulled out from the tape dispensing port and trained over the positioning roller 102. The distal end portion of the packing tape 15 is pressed on the desired surface by the positioning roller 102, the packing tape 15 adheres on the desired surface, as shown in FIG. 2. Under this condition, the blade protecting shield 14 is lifted by tension of the packing tape 15 so that the cutting edge of the cutter blade 122 is exposed and disposed adjacent to an extending route of the packing tape 15. The adhered portion of the packing tape 15 can be cut off by pressing the cutting edge of the cutter blade 122 toward the extending route of the packing tape 15. The static adhesion plates 121 serves to attract the distal end of the unused portion of the roll 101 of packing tape 15 thereon. An appropriate amount of force must be applied in order to permit the smoothing plate 123 to smoothen the cut strip of the packing tape 15 on the desired surface.

A main drawback of the conventional tape dispenser is that the protecting shield 14 covers the cutting edge of the blade 122 only when the tape dispenser is placed downwardly, such as when the tape dispenser is in use. When the dispensing port is disposed upwardly, the cutting edge of the blade is not covered by the protecting shield. Therefore, injury to an operator is likely to occur. In addition, the protecting shield must be manually lifted during use in order to permit a distal end portion of the packing tape to be pressed onto a surface of the object. This inconveniences the operator and prolongs the packing period.

SUMMARY OF THE INVENTION

A main objective of the present invention is to provide a tape dispenser which has a cutting device with a blade protecting shield that is capable of constantly covering a cutting edge thereof so that the user is not likely to be injured by the cutting edge of the cutting device.

Accordingly, the tape dispenser of the present invention includes a tape dispensing port and a cutting device provided adjacent to the tape dispensing port for cutting an adhered portion of packing tape from a tape end portion that extends along a tape route and that is pulled from the tape dispensing port. The cutting device includes a blade holding seat which has a front edge disposed adjacent to the tape extending route and a rear edge opposite to the front edge, a blade mounted on the blade holding seat and which has a cutting edge that protrudes out of the front edge of the blade holding seat, and a blade protecting shield mounted movably over the blade so as to dispose a front edge of the shield near the cutting edge of the blade. The tape dispenser of the present invention further includes means for guiding the protecting shield to slide forwardly and rearwardly and means for biasing a rear edge of the protecting shield so as to protrude the front edge of the shield relative to the cutting edge of the blade.

In the embodiment, the cutting device is mounted between two spaced mounting plates of a mounting frame which has a positioning roller mounted at the tape dispensing port. The cutting device also has a tape adhesion plate which extends from the blade holding seat and which terminates adjacent to the positioning roller. The adhesion plate serves to attract a distal end portion of the unused packing tape which extends out from the tape dispensing port. A smoothing plate extends from the blade holding seat and projects into the tape extending route so as to smoothen the used strip of tape on the desired surface of an object. The smoothing plate has a pair of aligned slots adjacent to and parallel with the blade holding seat which serves as the guiding means, while the rear edge of the protecting shield is provided with a pair of lugs which extend therefrom and which pass through the aligned slots of the smoothing plate. The biasing means is a compression spring disposed between the rear edge of the shield and the smoothing plate.

Since the cutting edge of the blade is automatically shielded by the protecting shield, the likelihood of being injured by the blade of the cutting device employed in the present invention is very small. The present invention further includes a stopper constituted by an elongated slot formed through one of the mounting plates and a screw-and-nut set which can be retained at a desired position along the elongated slot. The elongated slot extends transverse to a moving direction of the protecting shield. When the screw-and-nut set is moved to a position to engage the rear edge of the protecting shield to prevent the latter from moving in the rearward direction, the cutting edge of the blade is constantly shielded by the protecting shield. The cutting device of the tape dispenser of the present invention is usually kept at this condition when not in use so as to prevent injury to the user.

BRIEF DESCRIPTION OF THE DRAWINGS

Other features and advantages of the present invention will become more apparent in the following detailed description of the preferred embodiment, with reference to the accompanying drawings, of which.

DETAILED DESCRIPTION OF THE PREFERRED EMBODIMENT

Figure 1:
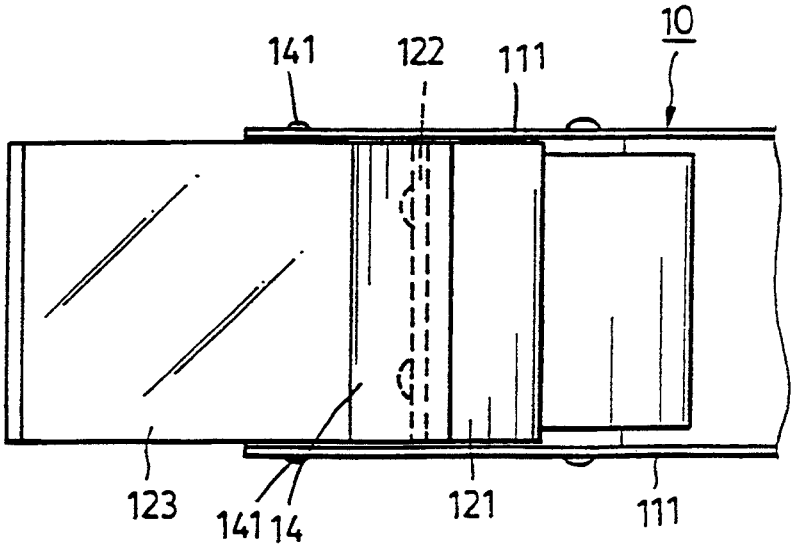
FIG.1 PRIOR ART
FIG. 1 is a top view of a conventional tape dispenser.
Figure 2:
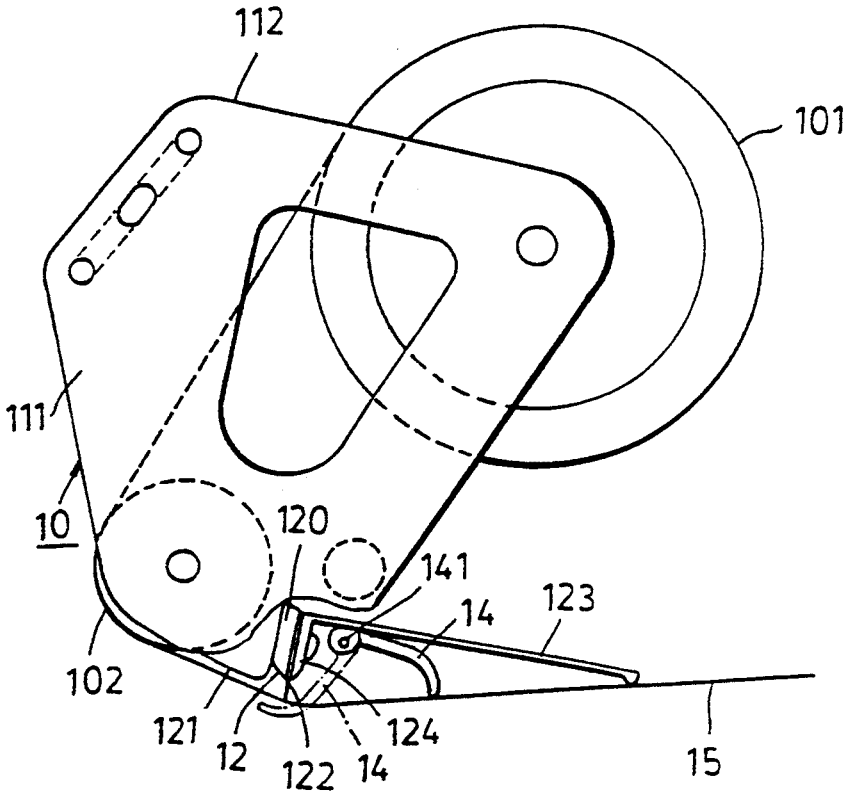
FIG.2 PRIOR ART
FIG. 2 is a side view of the conventional tape dispenser.
Figure 3:
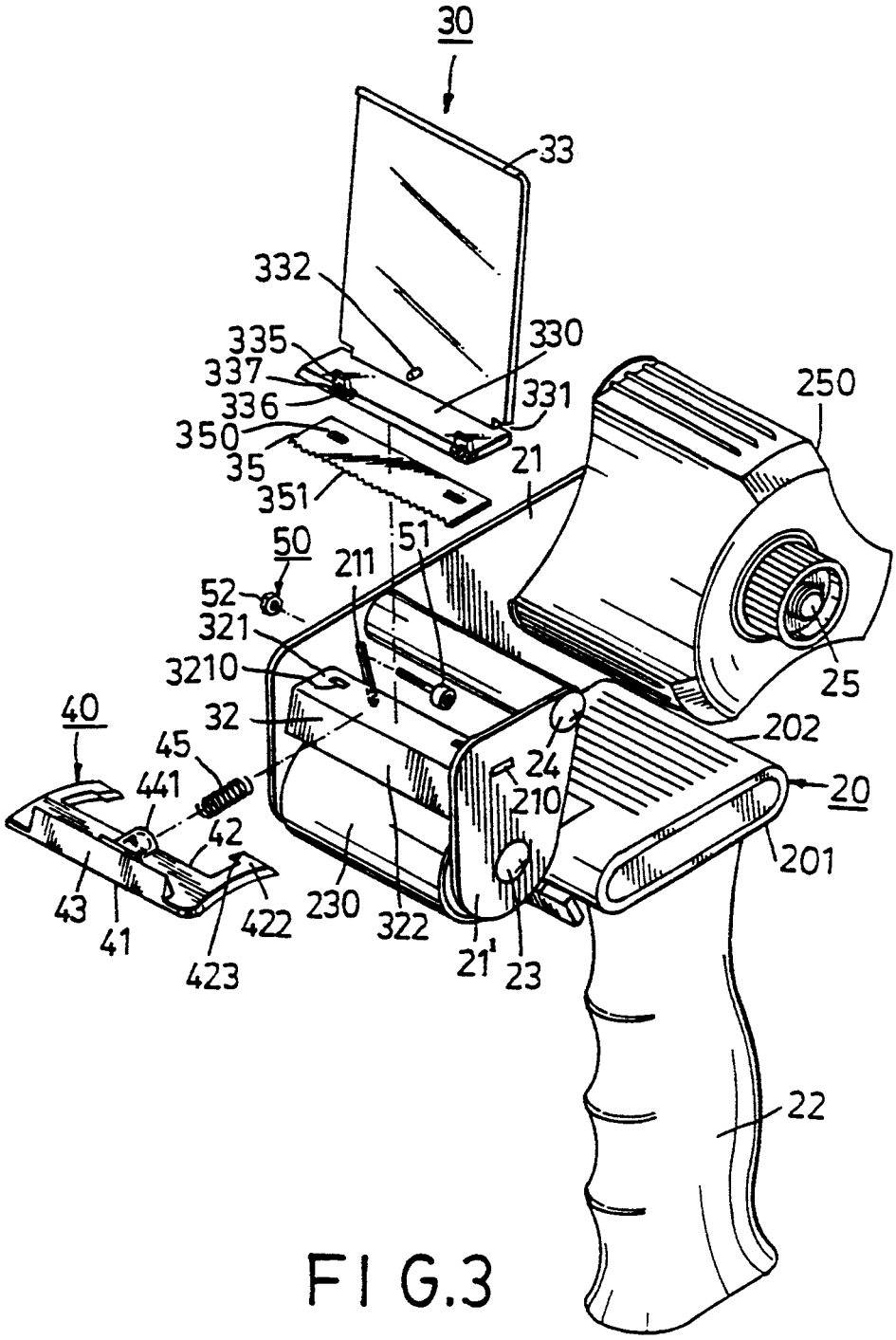
FIG. 3 is an exploded view of a first preferred embodiment of a tape dispenser of the present invention.

Referring to FIG. 3, an exploded perspective view of a first preferred embodiment of a tape dispenser according to the present invention is shown. The tape dispenser is a portable type and includes a mounting frame member 20, a cutting device 30 and a blade protecting shield 40. The mounting frame member 20 has first and second side faces 201, 202 that are opposite to one another. A handle 22 and a mounting plate 21 are fixed generally perpendicular to the first and second side faces 201, 202 of the mounting frame member 20 in a conventional manner. The mounting plate 21 is provided with a tape storage station, in the form of a combination of a shaft 25 and a tape-mounting roller 250 mounted rotatably on the shaft 25, at one end portion thereof and a tape dispensing port, also in the form of a combination of a shaft 23 and a positioning roller 230 mounted rotatably on the shaft 23, at another end portion. A stopping rod 24 is mounted in a parallel manner between the shafts 25, 23, the purpose of which will be described in the following paragraphs. Another mounting plate 21' is connected to the shafts 23, 24 by screw fasteners such that the two mounting plates 21, 21' are disposed opposite to one another. Each of the mounting plates 21, 21' has a mounting slot 210 formed therethrough.

The cutting device 30 employed in the tape dispenser of the present invention includes a blade holding seat 32, a cutter blade 35 and means for smoothing an adhered portion of the packing tape. The holding seat 32 is an L-shaped member which includes a horizontal portion 321 parallel to the positioning roller 230 and provided with two opposed end portions that are fixed in the mounting slots 210 between the opposed mounting plates 21, 21' and a vertical portion 322 which extends integrally from the horizontal portion 321 and which terminates adjacent to the positioning roller 230. The vertical portion 322 serves as an adhesion plate which attract a distal end of a roll of packing tape which is trained over the positioning roller 230. The horizontal portion 321 of the holding seat 32 is provided with a pair of mounting holes 3210 and has a front edge formed integrally with the vertical portion 322. The cutter blade 35 is provided on the horizontal portion 321 and has a pair of through holes 350 aligned with the mounting holes 3210 of the horizontal portion 321. The smoothing means is an L-shaped member made of a hard and resilient material, and includes a base plate 330 with a bottom surface that is formed with a pair of downwardly extending connecting projection units 335 and a smoothing plate 33 which is formed integrally with the base plate 330 and which extends substantially inclinedly from the base plate 330. Each of the connecting projection units 335 is formed with a downwardly extending slit 336 and distal ends which are provided with a pair of hook projections 337. When the base plate 330 of the smoothing means is provided on the horizontal portion 321 of the holding seat 32, the connecting projection units 335 of the smoothing plates 33 extend through the through-holes 350 of the cutter blade 35 and the mounting holes 3210 of the holding seat 32, thereby mounting the smoothing means and the cutter blade 35 removably on the blade holding seat 32. The cutter blade 35 has a cutting edge 351 projecting out of the front edge of the horizontal portion 321 of the holding seat 32. After the cutter device 30 is mounted, further bending action of the smoothing plate 33 when smoothing an adhered portion of the packing tape is prevented by the stopping rod 24 so that the smoothing plate 33 will not disengage untimely the holding seat 32.

A blade protecting shield 40 is provided movably above the cutter blade 35. The blade protecting shield 40 has a first edge 41 which is provided with an inclined flange 43 to be pressed by the packing tape and a second edge 42 opposite to the first edge 41. A pair of lugs 422 extend integrally from the second edge 42 of the shield 40. An intermediate portion in the second edge 42 of the shield 40 is formed with a socket member 441. The smoothing plate 33 has a spring engaging unit 332 formed on a surface thereof and a pair of aligned peripheral slots 331 formed adjacent to the lowermost portion thereof. The aligned peripheral slots 331 of the smoothing plate 33 are substantially parallel to the horizontal portion 321 of the holding seat 32 and serve as a guiding means when the protecting shield 40 moves frontwardly and rearwardly. The lugs 422 of the protecting shield 40 respectively have a hook 423 at their distal ends. After the lugs 422 have been extended through the aligned peripheral slots 331 of the smoothing plate 33, the hooks 423 engage the smoothing plates 33 to permit frontward movement of the shield 40. A biasing means 45, such as a compression spring, has two opposed end portions engaged within the socket member 441 of the shield 40 and the spring engaging unit 332 of the smoothing plate 33 such that the blade protecting shield 40 is biased to move away from the smoothing plate 33. Thus, the first edge 41 of the blade protecting shield 40 projects beyond and retractably covers a cutting edge 351 of the cutter blade 35.

Figure 4:
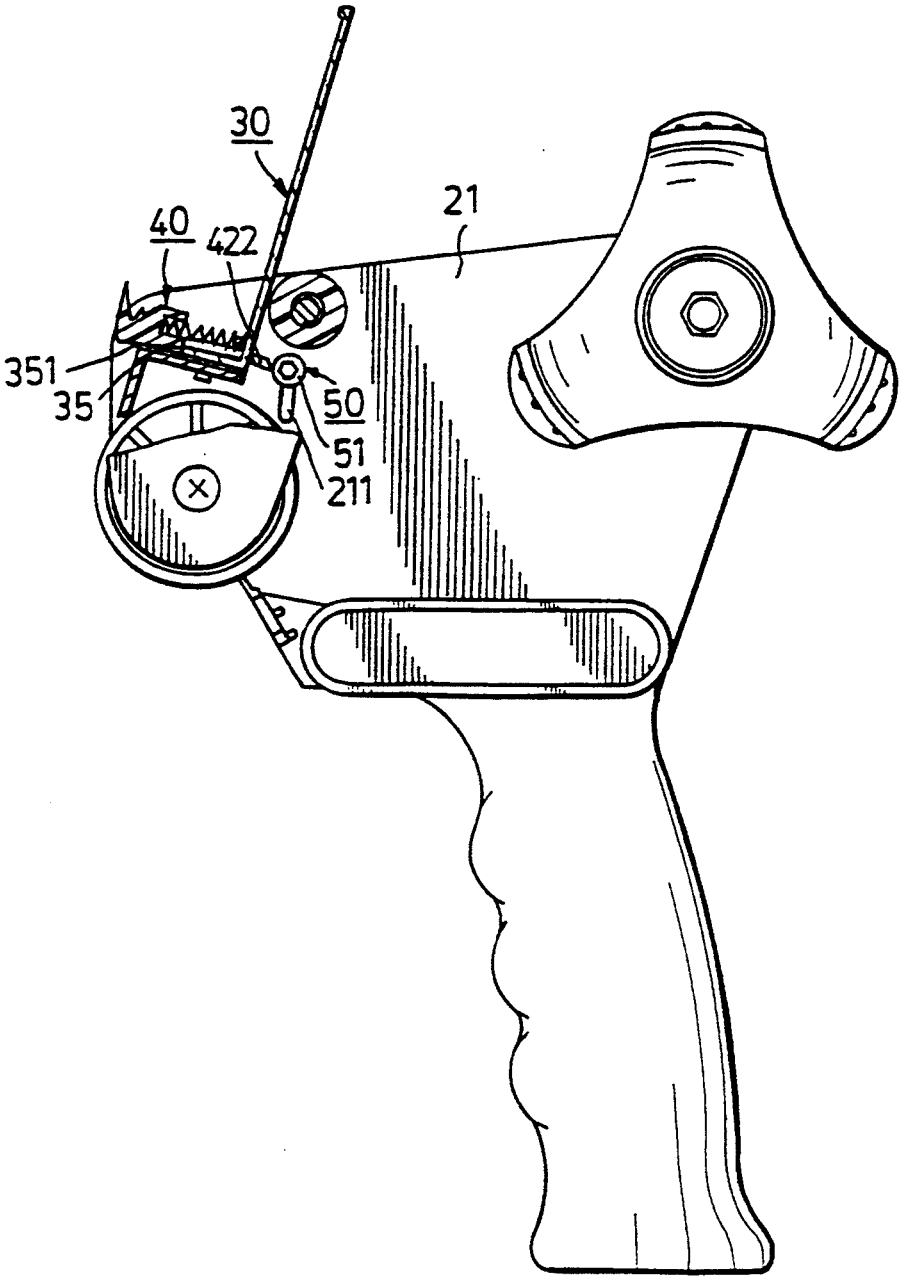
FIG. 4 is an assembled view of the tape dispenser of the present invention, a portion of a mounting plate being removed to illustrate the interior thereof.

Referring to FIG. 4, the cutting device 30 employed in the tape dispenser of the present invention is further provided with a stopper for engaging the lugs 422 of the protecting shield 40, thereby preventing the same from moving rearwardly. The stopper is constituted by an elongated slot 211 formed through one of the mounting plates 21 and a nut-and-screw set 50 which can be positioned selectively along the elongated slot 211. The elongated slot 211 extends transverse to the moving direction of the protecting shield 40. When the screw 51 is moved along the elongated slot 211 and is retained at a certain position by means of the nut 52 so as to engage the L-shaped hooked portions 422 of the shield 40, the shield 40 is prevented from moving in the rearward direction. Thus, the cutting edge 351 of the cutter blade 35 is shielded constantly. The cutting device 30 of the tape dispenser is generally placed under this condition when not in use so as to prevent injury to a person who 10 holds accidentally the tape dispenser at the cutting device 30.

Figure 5:
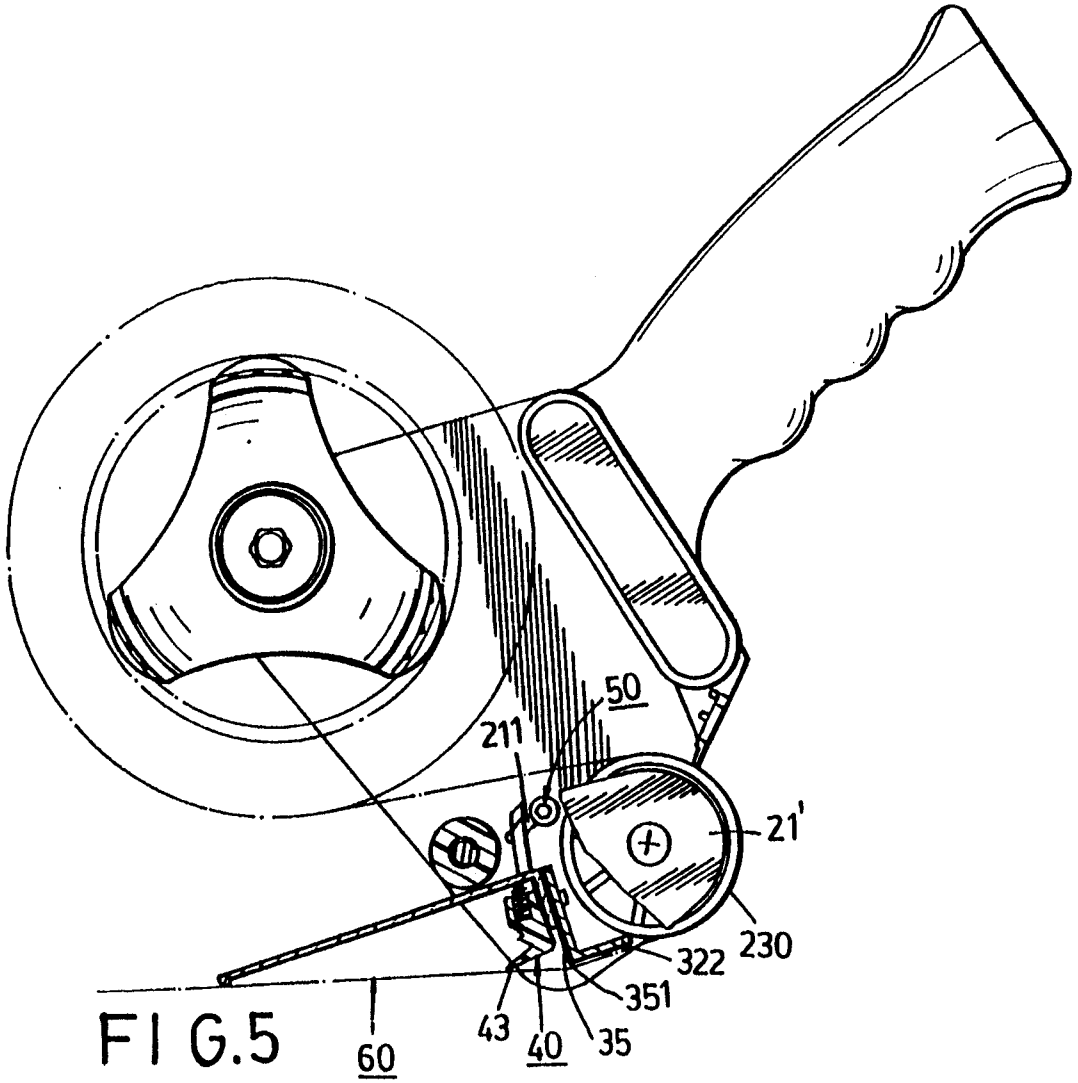
FIG. 5 illustrates the first preferred embodiment of the present invention when in use.

FIG. 5 illustrates the tape dispenser of the present invention when in use. The nut-and-screw set 50 is first moved to a position in order to permit the shield 40 to be movable rearwardly by virtue of the tension force of the packing tape which is pressed onto a desired surface of an object by the use of the positioning roller 230. The tension force of the packing tape causes the pressing flange 43 of the blade protecting shield 40 to retract rearwardly and correspondingly exposes the cutting edge 351 of the blade 35. Since the cutting edge 351 of the blade 35 extends transverse to a extending route of the packing tape 60, the used strip of packing tape 60 can be cut from the roll of packing tape by pressing the cutting edge 351 into the extending route of the packing tape. A relative force must be applied in order to smoothen the cut strip of packing tape on the desired surface of the object. The static adhesion plate 322 serves to attract a distal end of the unused end portion of the packing tape thereon.

Figure 6:
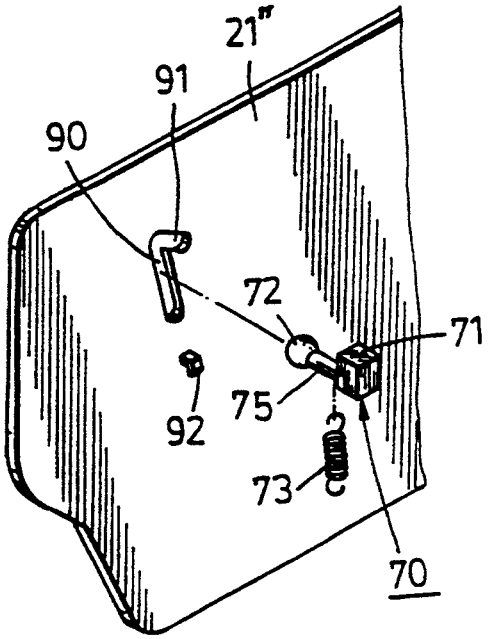
FIG. 6 shows a mounting plate and a stopper employed in a second preferred embodiment of the present invention.

Referring to FIG. 6, a second preferred embodiment of the tape dispenser of the present invention is shown to comprise a pair of stoppers different from the first embodiment. Each of the stopper is constituted by an elongated slot 90 formed through the mounting plate 21'', a hook member 92 formed integrally on the mounting plate 21'' below the elongated slot 90 and an engaging unit 70 which is disposed movably along the elongated slot 90 by the use of a tension spring 73. The elongated slot 90 has a curved portion 91. The engaging unit 70 includes a connecting rod 75 that extends through the slot 90. The connecting rod 75 has an engaging tab 71 formed integrally at one end thereof and a pushing knob 72 mounted detachably at another end thereof. When the engaging unit 70 is pulled against the restoring force of the tension spring 73 so as to be disposed in the curved portion 91, the engaging tab 71 engages the hooked portions 422 of the shield 40 and prevents the shield 40 from moving rearwardly. Removal of the engaging unit 70 from the curved portion 91 of the elongated slot 90 permits the shield 40 to move rearwardly. The feature and objective are the same as those of the first embodiment.

The cutting edge 351 of the blade 35 may get dull after a long period of use. When replacing the blade 35, the hooked projections 337 of the connecting shaft units 335 are simply pressed together and the connecting shaft units 335 are pushed upward so as to permit removal of the smoothing plate 33 from the blade holding seat 32. A new blade can be mounted in the previously described manner. No tool is required when removing or mounting the cutter assembly of the tape dispenser of the present invention.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangement.

I claim:

1. A tape dispenser with a cutting device mounted adjacent to a tape dispensing port thereof for cutting a strip of tape from a tape end portion which is pulled out from said tape dispensing port along a tape dispensing route, said tape dispenser being characterized in that said cutting device comprises:

a blade holding seat with a front edge and a rear edge opposite to said front edge, said holding seat being mounted fixedly adjacent to said tape dispensing port such that said front edge is nearby and transverse to said tape dispensing route and said rear edge is spaced from said tape dispensing route;

a blade having a front portion with a cutting edge and a rear portion which extends integrally and rearwardly from said front portion, said blade being mounted on said holding seat such that said cutting edge protrudes out of said front edge of said holding seat so as to extend into said tape dispensing route;

a blade protecting shield with a front edge and a rear edge, said shield being mounted movably above said blade such that said front edge thereof is disposed nearby said cutting edge of said blade;

means for guiding said shield to slide forwardly and rearwardly;

means for biasing said rear edge of said shield to push said front edge of said shield to protrude relative to said cutting edge of said blade;

said blade holding seat having a tape adhesion plate extending integrally from said front edge of said blade holding seat toward said tape dispensing port for guiding a distal end of an unused tape end portion that protrudes from said tape dispensing port;

said cutting device further comprising a smoothing means, said smoothing means having a base plate with a rear periphery, said base plate being mounted above said blade holding seat to sandwich said rear portion of said blade therebetween, said rear periphery of said base plate being disposed adjacent to said rear edge of said blade holding seat, said smoothing means further having a smoothing plate which extends from said rear periphery to a position in said tape dispensing route; and wherein said smoothing plate has a pair of aligned peripheral slots parallel to said base plate, said shield having a pair of spaced lugs extending integrally from said rear edge thereof and passing through said aligned peripheral slots of said smoothing plate so as to constitute said means for guiding said shield slidably forwardly and rearwardly.

2. A tape dispenser with a cutting device mounted adjacent to a tape dispensing port thereof for cutting a strip of tape from a tape end portion which is pulled out from said tape dispensing port along a tape dispensing route, said tape dispenser being characterized in that said cutting device comprises:

a blade holding seat with a front edge and a rear edge opposite to said front edge, said holding seat being mounted fixedly adjacent to said tape dispensing port such that said front edge is nearby and transverse to said tape dispensing route and said rear edge is spaced from said tape dispensing route;

a blade having a front portion with a cutting edge and a rear portion which extends integrally and rearwardly from said front portion, said blade being mounted on said holding seat such that said cutting edge protrudes out of said front edge of said holding seat so as to extend into said tape dispensing route;

a blade protecting shield with a front edge and a rear edge, said shield being mounted movably above said blade such that said front edge thereof is disposed nearby said cutting edge of said blade;

means for guiding said shield to slide forwardly and rearwardly;

means for biasing said rear edge of said shield to push said front edge of said shield to protrude relative to said cutting edge of said blade;

said blade holding seat having a tape adhesion plate extending integrally from said front edge of said blade holding seat toward said tape dispensing port for guiding a distal end of an unused tape end portion that protrudes from said tape dispensing port;

said cutting device further comprising a smoothing means, said smoothing means having a base plate with a rear periphery, said base plate being mounted above said blade holding seat to sandwich said rear portion of said blade therebetween, said rear periphery of said base plate being disposed adjacent to said rear edge of said blade holding seat, said smoothing means further having a smoothing plate which extends from said rear periphery to a position in said tape dispensing route;

said smoothing plate having a pair of aligned peripheral slots parallel to said base plate, said shield having a pair of spaced lugs extending integrally from said rear edge thereof and passing through said aligned peripheral slots of said smoothing plate so as to constitute said means for guiding said shield slidably forwardly and rearwardly; and wherein each of said lugs has a hook to engage said smoothing plate and stop said shield thereat when said shield has been slid forwardly to a position in which said cutting edge of said blade is shielded by said shield.

3. A tape dispenser with a cutting device mounted adjacent to a tape dispensing port thereof for cutting a strip of tape from a tape end portion which is pulled out from said tape dispensing port along a tape dispensing route, said tape dispenser being characterized in that said cutting device comprises:

a blade holding seat with a front edge and a rear edge opposite to said front edge, said holding seat being mounted fixedly adjacent to said tape dispensing port such that said front edge is nearby and transverse to said tape dispensing route and said rear edge is spaced from said tape dispensing route;

a blade having a front portion with a cutting edge and a rear portion which extends integrally and rearwardly from said front portion, said blade being mounted on said holding seat such that said cutting edge protrudes out of said front edge of said holding seat so as to extend into said tape dispensing route;

a blade protecting shield with a front edge and a rear edge, said shield being mounted movably above said blade such that said front edge thereof is disposed nearby said cutting edge of said blade;

means for guiding said shield to slide forwardly and rearwardly;

means for biasing said rear edge of said shield to push said front edge of said shield to protrude relative to said cutting edge of said blade;

said blade holding seat having a tape adhesion plate extending integrally from said front edge of said blade holding seat toward said tape dispensing port for guiding a distal end of an unused tape end portion that protrudes from said tape dispensing port;

said cutting device further comprising a smoothing means, said smoothing means having a base plate with a rear periphery, said base plate being mounted above said blade holding seat to sandwich said rear portion of said blade therebetween, said rear periphery of said base plate being disposed adjacent to said rear edge of said blade holding seat, said smoothing means further having a smoothing plate which extends from said rear periphery to a position in said tape dispensing route;

said smoothing plate having a pair of aligned peripheral slots parallel to said base plate, said shield having a pair of spaced lugs extending integrally from said rear edge thereof and passing through said aligned peripheral slots of said smoothing plate so as to constitute said means for guiding said shield slidably forwardly and rearwardly;

each of said lugs having a hook to engage said smoothing plate and stop said shield thereat when said shield has been slid forwardly to a position in which said cutting edge of said blade is shielded by said shield; and wherein said means for biasing said rear edge of said shield is a compression spring mounted between said rear edge of said shield and said smoothing plate.

4. A tape dispenser with a cutting device mounted adjacent to a tape dispensing port thereof for cutting a strip of tape from a tape end portion which is pulled out from said tape dispensing port along a tape dispensing route, said tape dispenser being characterized in that said cutting device comprises:

a blade holding seat with a front edge and a rear edge opposite to said front edge, said holding seat being mounted fixedly adjacent to said tape dispensing port such that said front edge is nearby and transverse to said tape dispensing route and said rear edge is spaced from said tape dispensing route;

a blade having a front portion with a cutting edge and a rear portion which extends integrally and rearwardly from said front portion, said blade being mounted on said holding seat such that said cutting edge protrudes out of said front edge of said holding seat so as to extend into said tape dispensing route;

a blade protecting shield with a front edge and a rear edge, said shield being mounted movably above said blade such that said front edge thereof is disposed nearby said cutting edge of said blade;

means for guiding said shield to slide forwardly and rearwardly;

means for biasing said rear edge of said shield to push said front edge of said shield to protrude relative to said cutting edge of said blade;

said blade holding seat having a tape adhesion plate extending integrally from said front edge of said blade holding seat toward said tape dispensing port for guiding a distal end of an unused tape end portion that protrudes from said tape dispensing port;

said cutting device further comprising a smoothing means, said smoothing means having a base plate with a rear periphery, said base plate being mounted above said blade holding seat to sandwich said rear portion of said blade therebetween, said rear periphery of said base plate being disposed adjacent to said rear edge of said blade holding seat, said smoothing means further having a smoothing plate which extends from said rear periphery to a position in said tape dispensing route;

said smoothing plate having a pair of aligned peripheral slots parallel to said base plate, said shield having a pair of spaced lugs extending integrally from said rear edge thereof and passing through said aligned peripheral slots of said smoothing plate so as to constitute said means for guiding said shield slidably forwardly and rearwardly;

each of said lugs having a hook to engage said smoothing plate and stop said shield thereat when said shield has been slid forwardly to a position in which said cutting edge of said blade is shielded by said shield;

said means for biasing said rear edge of said shield being a compression spring mounted between said rear edge of said shield and said smoothing plate; and characterized in that said cutting device further comprises a pair of stoppers each of which being movable to a position to engage a respective one of said spaced lugs of said shield to prevent rearward sliding of said shield.

5. A tape dispenser with a cutting device mounted adjacent to a tape dispensing port thereof for cutting a strip of tape from a tape end portion which is pulled out from said tape dispensing port along a tape dispensing route, said tape dispenser being characterized in that said cutting device comprises:

a blade holding seat with a front edge and a rear edge opposite to said front edge, said holding seat being mounted fixedly adjacent to said tape dispensing port such that said front edge is nearby and transverse to said tape dispensing route and said rear edge is spaced from said tape dispensing route;

a blade having a front portion with a cutting edge and a rear portion which extends integrally and rearwardly from said front portion, said blade being mounted on said holding seat such that said cutting edge protrudes out of said front edge of said holding seat so as to extend into said tape dispensing route;

a blade protecting shield with a front edge and a rear edge, said shield being mounted movably above said blade such that said front edge thereof is disposed nearby said cutting edge of said blade;

means for guiding said shield to slide forwardly and rearwardly;

means for biasing said rear edge of said shield to push said front edge of said shield to protrude relative to said cutting edge of said blade;

said blade holding seat having a tape adhesion plate extending integrally from said front edge of said blade holding seat toward said tape dispensing port for guiding a distal end of an unused tape end portion that protrudes from said tape dispensing port;

said cutting device further comprising a smoothing meads, said smoothing means having a base plate with a rear periphery, said base plate being mounted above said blade holding seat to sandwich said rear portion of said blade therebetween, said rear periphery of said base plate being disposed adjacent to said rear edge of said blade holding seat, said smoothing means further having a smoothing plate which extends from said rear periphery to a position in said tape dispensing route;

said smoothing plate having a pair of aligned peripheral slots parallel to said base plate, said shield having a pair of spaced lugs extending integrally from said rear edge thereof and passing through said aligned peripheral slots of said smoothing plate so as to constitute said means for guiding said shield slidably forwardly and rearwardly;

each of said lugs having a hook to engage said smoothing plate and stop said shield thereat when said shield has been slid forwardly to a position in which said cutting edge of said blade is shielded by said shield;

said means for biasing said rear edge of said shield being a compression spring mounted between said rear edge of said shield and said smoothing plate;

said cutting device further comprising a pair of stoppers each of which being movable to a position to engage a respective one of said spaced lugs of said shield to prevent rearward sliding of said shield; and wherein said shield further has an inclined flange which projects from said front edge thereof and which extends away from said tape dispensing port.

6. A tape dispenser with a cutting device mounted adjacent to a tape dispensing port thereof for cutting a strip of tape from a tape end portion which is pulled out from said tape dispensing port along a tape dispensing route, said tape dispenser being characterized in that said cutting device comprises:

a blade holding seat with a front edge and a rear edge opposite to said front edge, said holding seat being mounted fixedly adjacent to said tape dispensing port such that said front edge is nearby and transverse to said tape dispensing route and said rear edge is spaced from said tape dispensing route;

a blade having a front portion with a cutting edge and a rear portion which extends integrally and rearwardly from said front portion, said blade being mounted on said holding seat such that said cutting edge protrudes out of said front edge of said holding seat so as to extend into said tape dispensing route;

a blade protecting shield with a front edge and a rear edge, said shield being mounted movably above said blade such that said front edge thereof is disposed nearby said cutting edge of said blade;

means for guiding said shield to slide forwardly and rearwardly;

means for biasing said rear edge of said shield to push said front edge of said shield to protrude relative to said cutting edge of said blade;

said blade holding seat having a tape adhesion plate extending integrally from said front edge of said blade holding seat toward said tape dispensing port for guiding a distal end of an unused tape end portion that protrudes from said tape dispensing port;

said cutting device further comprising a smoothing means, said smoothing means having a base plate with a rear periphery, said base plate being mounted above said blade holding seat to sandwich said rear portion of said blade therebetween, said rear periphery of said base plate being disposed adjacent to said rear edge of said blade holding seat, said smoothing means further having a smoothing plate which extends from said rear periphery to a position in said tape dispensing route;

said smoothing plate having a pair of aligned peripheral slots parallel to said base plate, said shield having a pair of spaced lugs extending integrally from said rear edge thereof and passing through said aligned peripheral slots of said smoothing plate so as to constitute said means for guiding said shield slidably forwardly and rearwardly;

each of said lugs having a hook to engage said smoothing plate and stop said shield thereat when said shield has been slid forwardly to a position in which said cutting edge of said blade is shielded by said shield;

said means for biasing said rear edge of said shield being a compression spring mounted between said rear edge of said shield and said smoothing plate;

said cutting device further comprising a pair of stoppers each of which being movable to a position to engage a respective one of said spaced lugs of said shield to prevent rearward sliding of said shield;

said shield further having an inclined flange which projects from said front edge thereof and which extends away from said tape dispensing port; and wherein said tape dispenser is a portable type with a mounting frame and a handgrip portion extending therefrom, said mounting frame having two spaced mounting plates, said cutting device being mounted fixedly between said mounting plates.

* * * * *

UNITED STATES PATENT AND TRADEMARK OFFICE

CERTIFICATE OF CORRECTION

PATENT NO. : 5,393,367

DATED : February 28, 1995

INVENTOR(S) : Hsiu-Man Yu Chen

It is certified that error appears in the above-indentified patent and that said Letters Patent is hereby corrected as shown below:

Column 5, line 6, delete --10--.

Column 9, claim 5, line 62, "meads" should be --means--.

Signed and Sealed this

Fourth Day of July, 1995

Bruce Lehman

*Attest:*

BRUCE LEHMAN

*Attesting Officer*

*Commissioner of Patents and Trademarks*